US011052657B2

(12) United States Patent
Yoshimura et al.

(10) Patent No.: US 11,052,657 B2
(45) Date of Patent: Jul. 6, 2021

(54) DROPLET DISCHARGING DEVICE

(71) Applicant: SEIKO EPSON CORPORATION, Tokyo (JP)

(72) Inventors: Akihiro Yoshimura, Hokuto (JP); Katsuya Asamoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/343,928

(22) PCT Filed: Oct. 6, 2017

(86) PCT No.: PCT/JP2017/036435
§ 371 (c)(1),
(2) Date: Apr. 22, 2019

(87) PCT Pub. No.: WO2018/074258
PCT Pub. Date: Apr. 26, 2018

(65) Prior Publication Data

US 2020/0055313 A1 Feb. 20, 2020

(30) Foreign Application Priority Data

Oct. 21, 2016 (JP) ..... JP2016-206616

(51) Int. Cl.
*B41J 2/045* (2006.01)
*B41J 29/377* (2006.01)
(Continued)

(52) U.S. Cl.
CPC ..... *B41J 2/04581* (2013.01); *B41J 2/14* (2013.01); *B41J 2/15* (2013.01); *B41J 29/377* (2013.01);
(Continued)

(58) Field of Classification Search
CPC ..... B41J 2/14072; B41J 2002/14491
See application file for complete search history.

(56) References Cited

U.S. PATENT DOCUMENTS 5,096,316 A 3/1992 Otsuka et al.
2006/0152541 A1 7/2006 Isozaki et al.
(Continued)

FOREIGN PATENT DOCUMENTS

EP 2789463 A1 10/2014
JP 2005-254619 A 9/2005
(Continued)

*Primary Examiner* — Julian D Huffman
(74) *Attorney, Agent, or Firm* — Workman Nydegger

(57) ABSTRACT

Provided is a droplet discharging device that can efficiently couple a droplet discharging head and a head driving circuit by a cable. A droplet discharging device includes a droplet discharging head, a head driving circuit configured to drive the droplet discharging head, a carriage configured to move while supporting the droplet discharging head and the head driving circuit, and a cable configured to electrically couple a head connector of the droplet discharging head and a circuit connector of the head driving circuit, the cable being detachably coupled to the head connector and to the circuit connector. The droplet discharging head and the head driving circuit are disposed such that the head connector and the head driving circuit do not overlap in a direction of pull-out of the cable from the head connector and the circuit connector and the droplet discharging head do not overlap in a direction of pull-out of the cable from the circuit connector.

5 Claims, 5 Drawing Sheets

(51) Int. Cl.
*B41J 2/14* (2006.01)
*B41J 2/15* (2006.01)

(52) U.S. Cl.
CPC .. *B41J 2002/14491* (2013.01); *B41J 2202/08* (2013.01)

(56) References Cited

U.S. PATENT DOCUMENTS

| | | | | |
|---|---|---|---|---|
| 2015/0032149 | A1 | 1/2015 | Croushorn et al. | |
| 2015/0077473 | A1* | 3/2015 | Wanibe ..... | B41J 29/377 347/50 |

FOREIGN PATENT DOCUMENTS

| | | | |
|---|---|---|---|
| JP | 2006-264328 | | 10/2006 |
| JP | 2010-131961 | A | 6/2010 |
| JP | 2013-120861 | A | 6/2013 |
| JP | 2014-148121 | A | 8/2014 |
| JP | 2014-156128 | | 8/2014 |

* cited by examiner

DROPLET DISCHARGING DEVICE

This application is a 371 National Stage of PCT Application No. PCT/JP2017/036435 filed Oct. 6, 2017, which claims priority to Japanese Patent Application No. 2016-206616, filed Oct. 21, 2016, the entireties of which are incorporated by reference herein.

TECHNICAL FIELD

The present disclosure relates to a droplet discharging device such as an ink jet-type printer, for example.

BACKGROUND ART

Generally, ink jet-type printers have been widely known as a type of droplet discharging device (refer to JP-A-2013-120861, for example). Such a printer includes a head (droplet discharging head) configured to discharge ink and a carriage configured to move in a scanning direction in a state of supporting the head, and performs printing by discharging ink from the head toward a medium while moving the carriage in the scanning direction. Then, among such printers, there are printers provided with a head driver integrated circuit (head driving circuit) configured to drive the head, mounted on the carriage (refer to JP-A-2013-120861, for example).

CITATION LIST

Patent Literature

[PTL 1] JP-A-2013-120861

SUMMARY OF INVENTION

Technical Problem

In such a printer as described above, an arrangement of the head and the head driver integrated circuit on the carriage does not take into account a task of electrically coupling the head and the head driver integrated circuit by a cable. As a result, there is room for improvement in efficiently carrying out the task of coupling the droplet discharging head and the head driving circuit by the cable.

Note that the above-described circumstance is generally a common issue, not only in an ink jet-type printer, but also in a droplet discharging device in which a droplet discharging head configured to discharge a droplet and a head driving circuit configured to drive the droplet discharging head are supported by a carriage and the droplet discharging head and the head driving circuit are connected by a cable.

The present disclosure is derived in light of such issues that exist in the related art. An advantage of the present disclosure is to provide a droplet discharging device that allows a task of coupling a droplet discharging head and a head driving circuit by a cable to be carried out efficiently.

Solution to Problem

Hereinafter, measures for eliminating the above-described issues and advantages of the measures will be described.

A droplet discharging device for eliminating the above-described issues includes a droplet discharging head configured to discharge a droplet, a head driving circuit configured to drive the droplet discharging head, a carriage configured to move in a scanning direction in a state in which the carriage supports the droplet discharging head and the head driving circuit, and a cable configured to electrically couple a head connector of the droplet discharging head and a circuit connector of the head driving circuit, the cable being detachably coupled to the head connector and to the circuit connector. The droplet discharging head and the head driving circuit are disposed such that the head connector and the head driving circuit do not overlap in a direction of pull-out of the cable from the head connector, and the circuit connector and the droplet discharging head do not overlap in a direction of pull-out of the cable from the circuit connector.

According to this configuration, the head driving circuit does not interfere when the cable is inserted into and removed from the head connector, and the droplet discharging head does not interfere when the cable is inserted into and removed from the circuit connector. As a result, the task of coupling the droplet discharging head and the head driving circuit by a cable can be efficiently carried out.

Preferably, the droplet discharging device includes a plurality of the droplet discharging heads disposed in an array, and a plurality of the head driving circuits disposed in an array, and an arrangement direction of the plurality of the droplet discharging devices and an arrangement direction of the plurality of the head driving circuits may be the same.

According to this configuration, a combination of the droplet discharging head and the head driving circuit coupled by the cable can be easily changed.

Preferably, the droplet discharging device includes a guide member configured to guide the carriage in the scanning direction while supporting the carriage, the carriage is supported by a side portion of the guide member, and the head driving circuit is disposed at an upper side of the guide member.

According to this configuration, compared to when the head driving circuit is disposed on the same side portion of the guide member as the carriage, a weight balance of the carriage can be improved. As a result, the carriage can be stably moved in the scanning direction.

Preferably, the droplet discharging device includes an airflow generating unit configured to cool the head driving circuit.

According to this configuration, the head driving circuit can be favorably cooled by an airflow generated by the airflow generating unit.

Preferably, in the droplet discharging device, a plurality of the airflow generating units are provided along a movement region of the carriage.

According to this configuration, the head driving circuit can be favorably cooled by the airflow generating unit even while the carriage is moved.

Preferably, the droplet discharging device includes a temperature detection unit supported by the carriage, and airflow generation from the airflow generating unit is controlled according to a temperature detected by the temperature detection unit.

According to this configuration, the airflow from the airflow generating unit is strengthened when the detected temperature by the temperature detection unit is relatively high, and weakened when the detected temperature by the temperature detection unit is relatively low, making it possible to cool the head driving circuit efficiently by the airflow generating unit.

DESCRIPTION OF EMBODIMENTS

One exemplary embodiment of a droplet discharging device will be described below with reference to the accompanying drawings. Note that the droplet discharging device of the exemplary embodiment is an ink jet-type printing apparatus configured to form characters and images by discharging ink as an example of a droplet onto a medium M such as a sheet.

Figure 1:
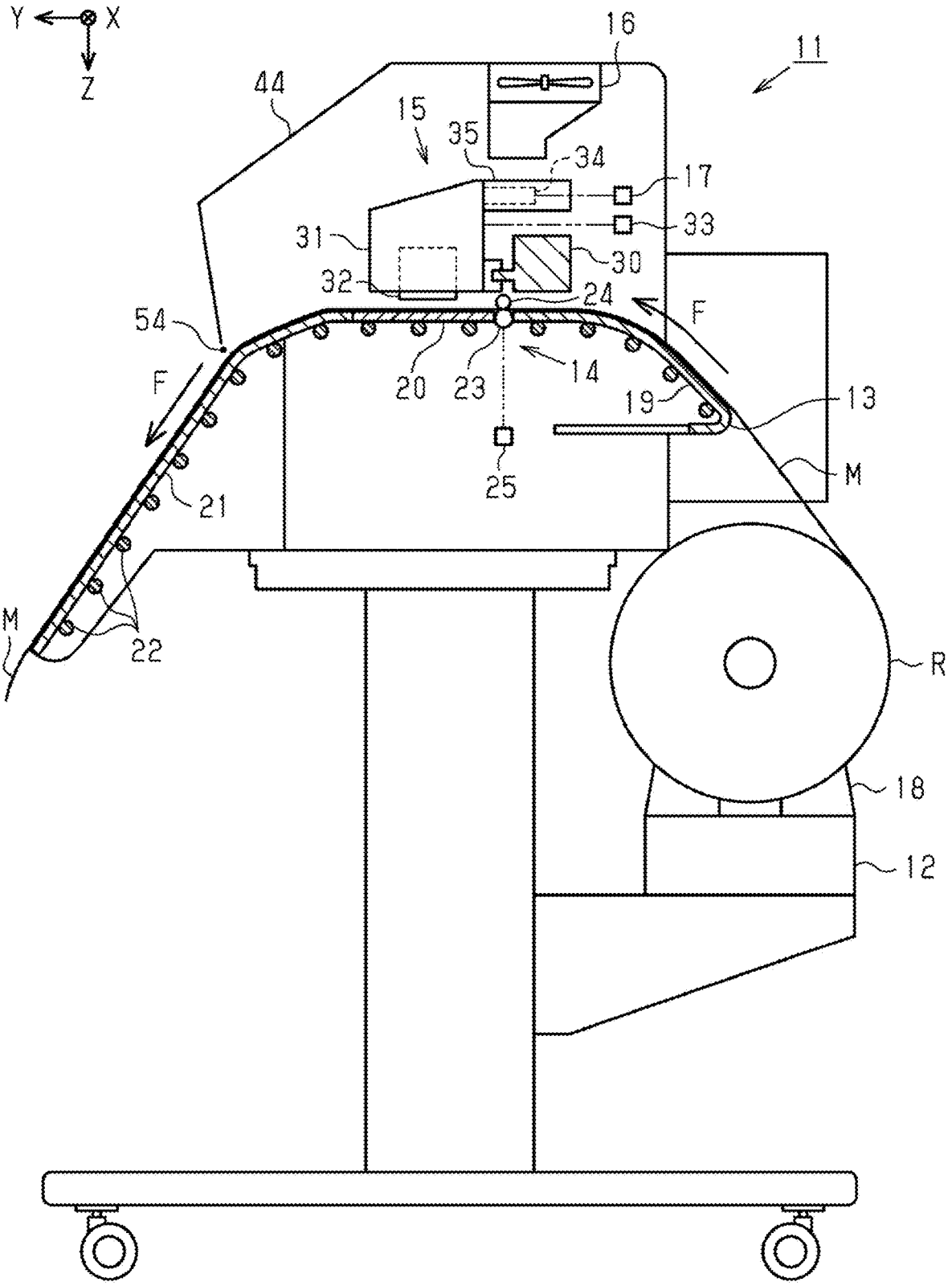
FIG. 1 is a schematic side view of a printing apparatus according to one exemplary embodiment.

As illustrated in FIG. 1, as an example of a droplet discharging device, a printing apparatus 11 includes a feeding unit 12 configured to feed the medium M, a support unit 13 configured to support the medium M, a transport unit 14 configured to transport the medium M, a printing unit 15 configured to perform printing on the medium M, an air blowing unit 16 configured to blow a gas toward the printing unit 15, and a control unit 17 configured to control these components.

Note that, in the following description, a width direction of the printing apparatus 11 is referred to as a "scanning direction X", a depth direction of the printing apparatus 11 is referred to as a "front-rear direction Y", a height direction of the printing apparatus 11 is referred to as a "vertical direction Z", and a direction in which the medium M is transported is referred to as a "transport direction F". The scanning direction X, the front-rear direction Y, and the vertical direction Z are directions intersecting (orthogonal to) each other, and the transport direction F is a direction intersecting (orthogonal to) the scanning direction X.

The feeding unit 12 includes a holding member 18 configured to rotatably hold a roll body R on which the medium M is wound. The holding member 18 holds different types of media M, and roll bodies R with different dimensions in the scanning direction X. Then, the medium M is unwound from the roll body R and fed toward the support unit 13 by rotating the roll body R in one direction (the counter-clockwise direction in FIG. 1) at the feeding unit 12.

The support unit 13 includes a first support unit 19, a second support unit 20, and a third support unit 21 that form a transport path of the medium M from upstream in the transport direction toward a downstream in the transport direction. The first support unit 19 guides the medium M fed from the feeding unit 12 toward the second support unit 20, the second support unit 20 supports the medium M on which printing is to be performed, and the third support unit 21 guides the medium M on which printing has been performed downstream in the transport direction.

Heating units 22 configured to heat the first support unit 19, the second support unit 20, and the third support unit 21 are provided on a side of the first support unit 19, the second support unit 20, and the third support unit 21 opposite to the transport path side for the medium M. The heating units 22 heat the first support unit 19, the second support unit 20, and the third support unit 21, and thus indirectly heat the medium M supported by these first to third support units 19 to 21. The heating units 22 are each configured with a heating wire (heater wire) and the like, for example.

The transport unit 14 includes a transport roller 23 configured to apply a transport force to the medium M, a driven roller 24 configured to press the medium M against the transport roller 23, and a rotation mechanism 25 configured to drive the transport roller 23. The transport roller 23 and the driven roller 24 are rollers with the scanning direction X serving as an axis direction.

The transport roller 23 is disposed vertically below the transport path of the medium M, and the driven roller 24 is disposed vertically above the transport path of the medium M. The rotation mechanism 25 may be configured with a motor and a reduction gear, or the like, for example. Then, the transport unit 14 transports the medium M in the transport direction F by rotating the transport roller 23 in a state where the medium M is pinched between the transport roller 23 and the driven roller 24.

Figure 2:
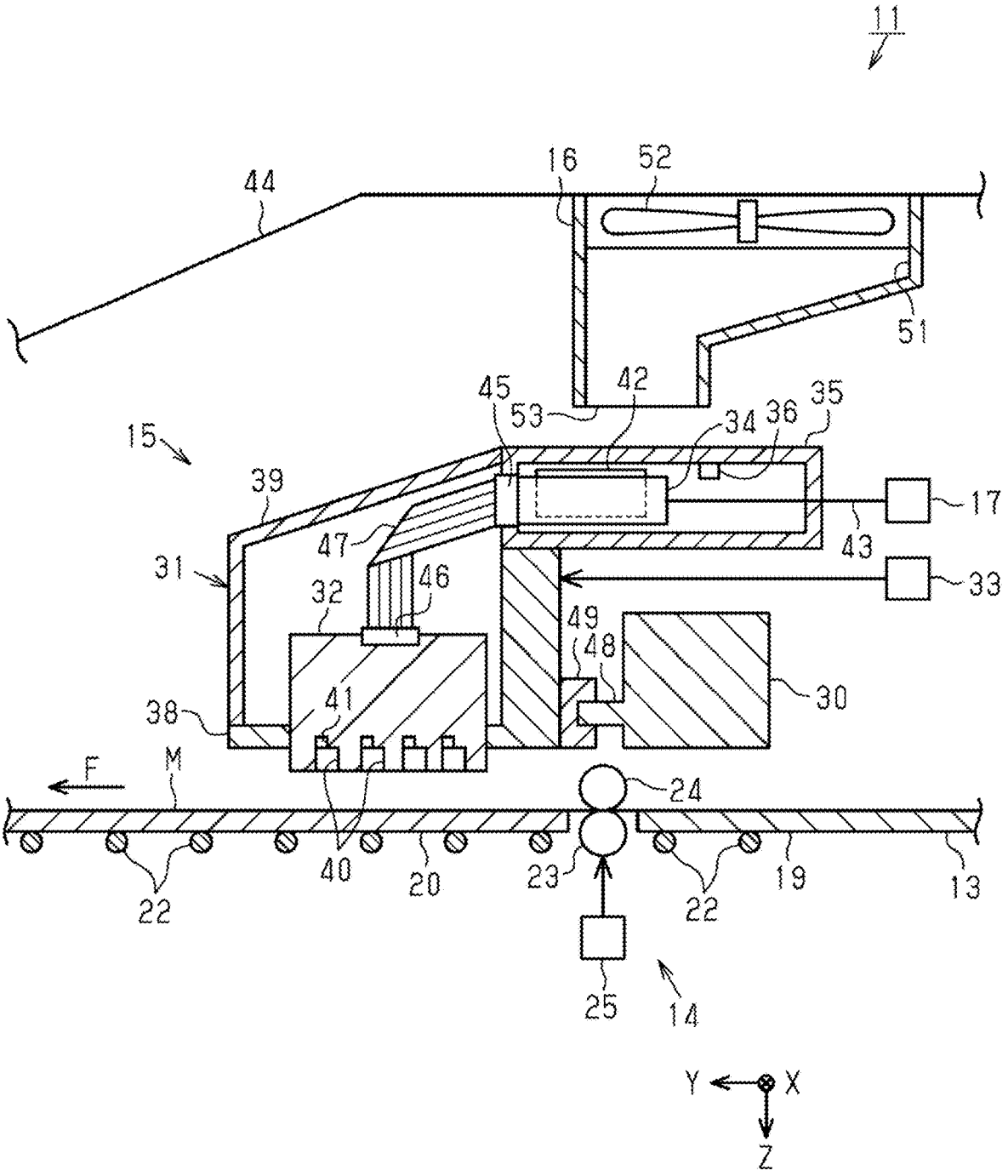
FIG. 2 is a schematic side view of a peripheral configuration of a printing unit of the printing apparatus.
Figure 3:
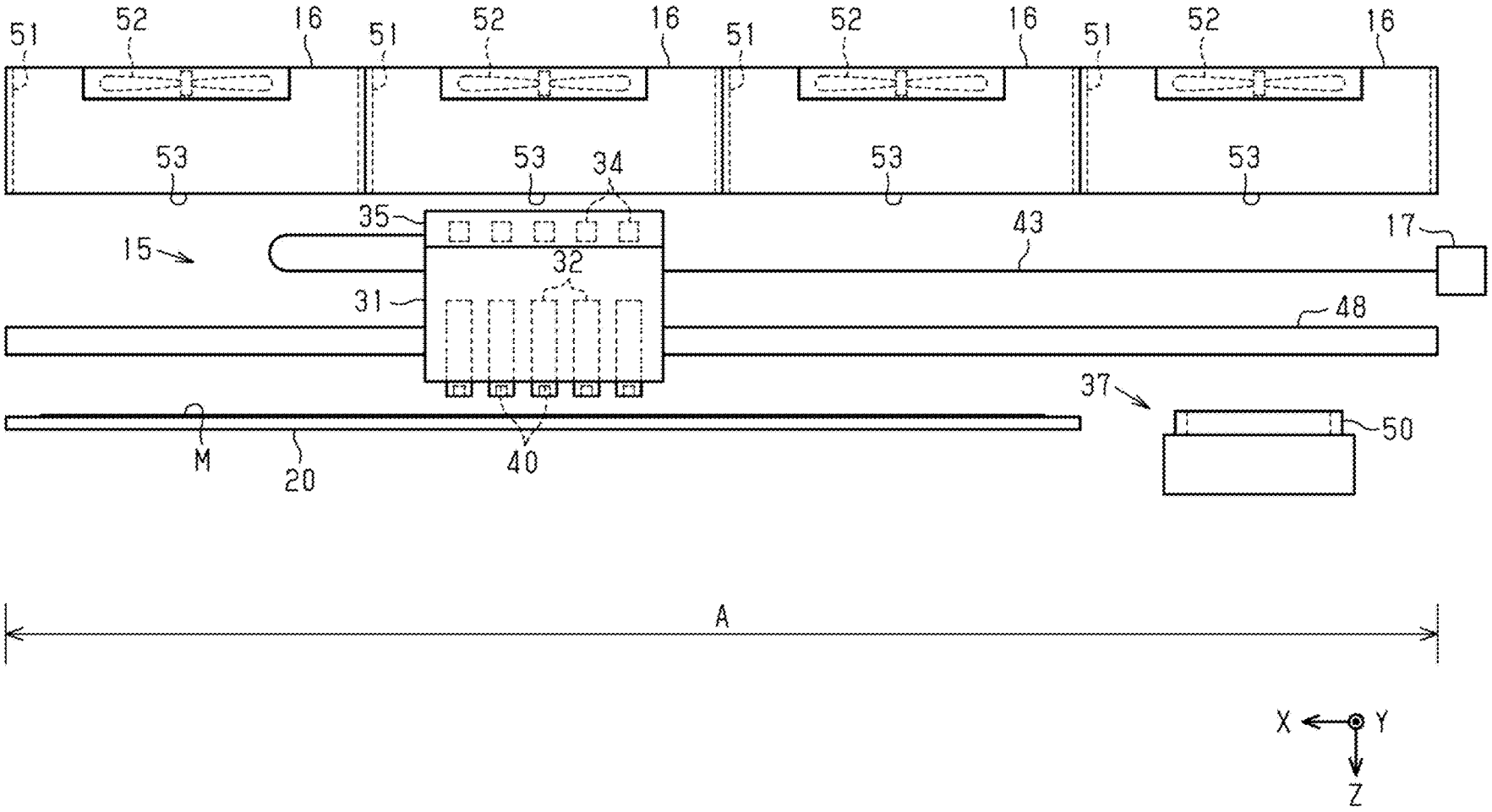
FIG. 3 is a schematic front view of a peripheral configuration of the printing unit of the printing apparatus.

As illustrated in FIG. 2 and FIG. 3, the printing unit 15 includes a guide member 30 extending in the scanning direction X, a carriage 31 supported by the guide member 30 and movable in the scanning direction X, a plurality of (five in the exemplary embodiment) droplet discharging heads 32 supported by the carriage 31 and configured to discharge ink onto the medium M, and a movement mechanism 33 configured to move the carriage 31 in the scanning direction X.

Furthermore, the printing unit 15 includes a plurality of (five in the exemplary embodiment) head driving circuits 34 that are supported by the carriage 31 and respectively drive the plurality of droplet discharging heads 32, a heat dissipation case 35 for accommodating the each head driving circuit 34, a temperature detection unit 36 configured to detect a temperature inside the heat dissipation case 35, and a maintenance unit 37 configured to perform maintenance on the each droplet discharging head 32.

The carriage 31 includes a carriage main body 38 having a cross section when viewed from the scanning direction X that forms an L shape, and a cover member 39 that is detachably attached to the carriage main body 38 and forms a closed space with the carriage main body 38. The plurality of droplet discharging heads 32 are supported in a lower portion inside the carriage 31 in a state of being arranged at an equal interval in the scanning direction X, and lower end portions of the each droplet discharging head 32 protrude from a lower face of the carriage 31 to the outside. On lower faces of the each droplet discharging head 32, a plurality of nozzles 40 configured to discharge ink are open in a state of being arranged in the front-rear direction Y.

Each of the droplet discharging heads 32 are so-called ink jet heads in which an actuator 41 such as a piezoelectric element driven to discharge ink is included for each nozzle 40, and the opening of each of the nozzles 40 faces the second support unit 20 in a state being supported by the carriage 31. The movement mechanism 33 is a mechanism that includes a motor and a reduction gear, and converts a rotation force of the motor into a movement force in the scanning direction X of the carriage 31. As a result, in the exemplary embodiment, driving the movement mechanism 33 reciprocates the carriage 31 in the scanning direction X in a state where the carriage 31 supports the plurality of droplet discharging heads 32 and the plurality of head driving circuits 34.

Figure 4:
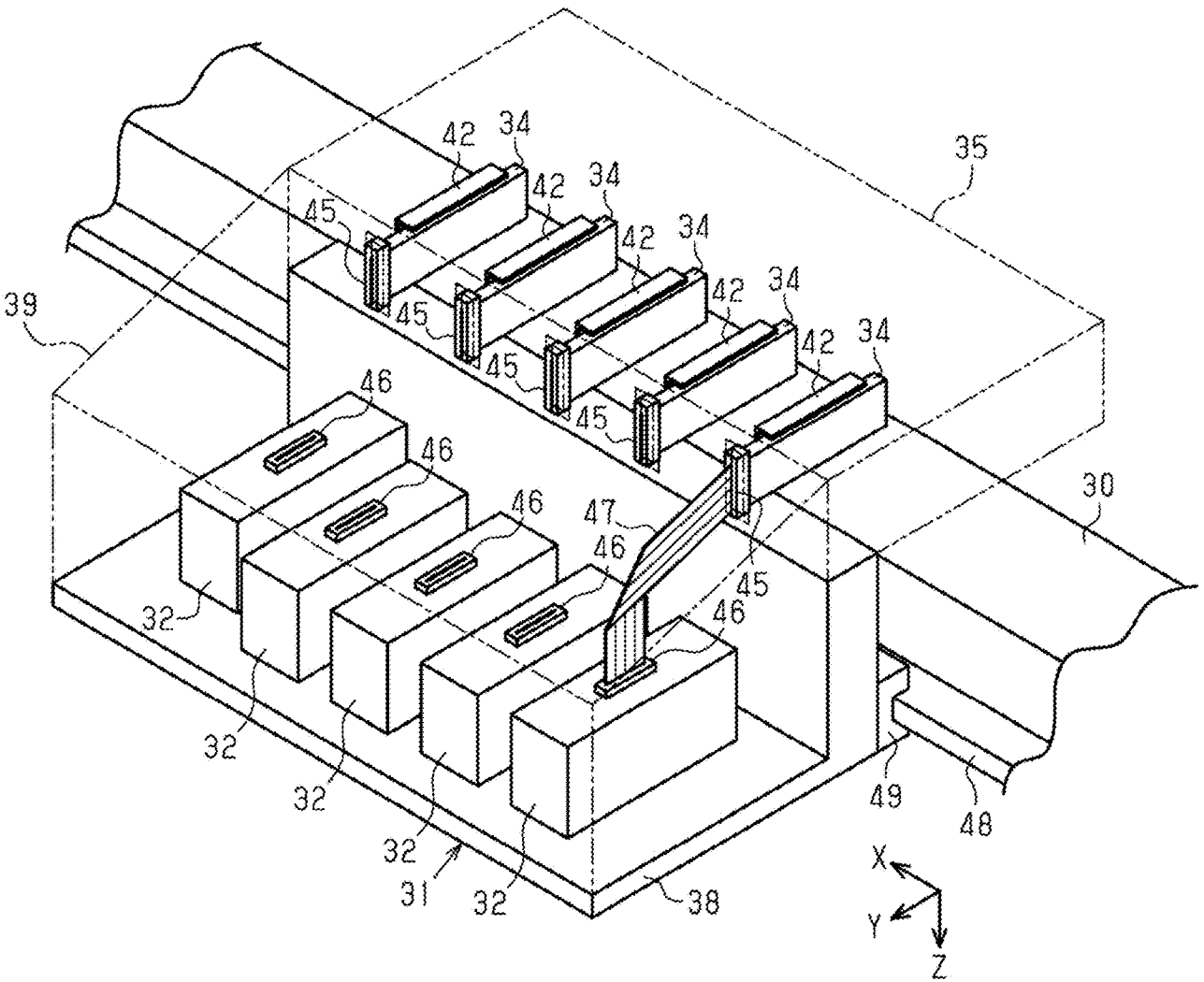
FIG. 4 is a schematic perspective view illustrating an inside of a carriage.

As illustrated in FIG. 2 and FIG. 4, a front end portion of the heat dissipation case 35 having a rectangular parallelepiped shape and accommodating the each head driving circuit 34 in a contact state is fixed to an upper end portion of a rear portion of the carriage 31. Thus, each of the head driving circuits 34 are supported by the carriage 31 via the heat dissipation case 35. Each of the head driving circuits 34 are supported inside the heat dissipation case 35 in a state being arranged at an equal interval in the scanning direction X. Thus, an arrangement direction of the each head driving circuit 34 and an arrangement direction of the each droplet discharging head 32 are the same. A heat dissipation plate 42 for dissipating heat generated by each of the head driving circuits 34 is attached to each of the head driving circuits 34.

Here, the heat dissipation case 35 is configured to dissipate heat generated in each of the head driving circuits 34 outward, and thus is preferably configured as follows. That is, the heat dissipation case 35 preferably has a larger contact area with each of the head driving circuits 34 to increase an amount of transferred heat from each of the head driving circuits 34. Further, the heat dissipation case 35 is preferably formed of a metal material having a high heat conductivity such as aluminum to make it easier to transfer heat from an inside of the heat dissipation case 35 that contacts each of the head driving circuits 34 to an outside of the heat dissipation case 35 that contacts ambient air. Furthermore, the heat dissipation case 35 is preferably provided with a heat dissipation fin on the outside, and preferably has a larger area that contacts the ambient air, in order to increase the amount of dissipated heat to the ambient air.

As illustrated in FIG. 2 and FIG. 4, each of the head driving circuits 34 are electrically coupled to the control unit 17 via a control cable 43. The control cable 43 is configured to electrically couple each of the head driving circuits 34 supported by the carriage 31 reciprocating in the scanning direction X, and the control unit 17 fixedly disposed inside a housing 44 of the printing apparatus 11, and thus is preferably a flexible flat cable (FFC) that follows and deforms along with the reciprocation of the carriage 31.

The head driving circuits 34 each include a circuit connector 45 on a front end portion of the head driving circuit 34, and the each circuit connector 45 are exposed inside the carriage 31 from a front face of the heat dissipation case 35. The droplet discharging heads 32 each include a head connector 46 on an upper face of the droplet discharging head 32. One end portion of a cable 47 configured with an FFC or the like, for example, is detachably coupled (removably coupled) to the circuit connector 45 at one end, and the other end portion of the cable 47 is detachably (removably) coupled to the head connector 46. That is, each of the head driving circuits 34 and each of the droplet discharging heads 32 are electrically coupled via the cables 47.

In this case, the circuit connectors 45 each face frontward, and the head connectors 46 each face upward. That is, the droplet discharging heads 32 and the head driving circuits 34 are each disposed so that the head connector 46 and the head driving circuit 34 do not overlap in a direction in which the cable 47 is pulled out from the head connector 46 (upward in the exemplary embodiment), and the circuit connector 45 and the droplet discharging head 32 do not overlap in a direction in which the cable 47 is pulled out from the circuit connector 45 (frontward in the exemplary embodiment). In other words, the direction in which the cable 47 is inserted into and removed from the head connector 46 of the each droplet discharging head 32, and the direction in which the cable 47 is inserted into and removed from the circuit connector 45 of the each head driving circuit 34 are different.

Note that the circuit connector 45 of each head driving circuit 34 and the head connector 46 of each droplet discharging head 32 may not necessarily be coupled by the cable 47 corresponding in the front-rear direction Y each other, and the combination of the circuit connector 45 and the head connector 46 coupled by the cable 47 may be changed as appropriate. In this case, a portion of the circuit connectors 45 and the head connectors 46 that are not coupled by the cable 47 may exist.

As illustrated in FIG. 2 and FIG. 4, the guide member 30 includes a guide rail portion 48 extending in the scanning direction X to a front face lower portion of the guide member 30. The carriage 31 is movably supported in the scanning direction X by the guide rail portion 48 in a carriage support unit 49 provided to a rear face lower portion of the carriage 31. That is, the carriage support unit 49 is slidably coupled in the scanning direction X to the guide rail portion 48. That is, the carriage 31 reciprocates in the scanning direction X while guided by the guide rail portion 48 of the guide member 30 in the carriage support unit 49, by the driving of the movement mechanism 33.

In this case, the carriage 31 is positioned on a side portion on a front side of the guide member 30, and the heat dissipation case 35 accommodating each of the head driving circuits 34 is positioned on an upper side of the guide member 30. As a result, a rotational moment of the carriage 31 with the carriage support unit 49 serving as a fulcrum is kept small, and a length of the cable 47 is kept short. Thus, a weight balance of the carriage 31 is stabilized, and the signals outputted from each of the head driving circuits 34 to each of the droplet discharging heads 32 are stabilized.

Incidentally, when the head driving circuits 34 are each disposed on upper sides of the each droplet discharging head 32 in the carriage 31, that is, when the carriage 31 and the heat dissipation case 35 are both disposed on the side portion on the front side of the guide member 30, the length of the cable 47 is kept to a minimum, but the rotational moment of the carriage 31 with the carriage support unit 49 serving as the fulcrum increases.

On the other hand, when the heat dissipation case 35 is disposed on a side portion on a rear side of the guide member 30, which is the side portion on a side opposite to the carriage 31, sandwiching the guide member 30, the rotational moment of the carriage 31 with the carriage support unit 49 serving as the fulcrum can be kept small, but the length of the cable 47 increases. Note that, to stabilize the signal outputted from each of the head driving circuits 34 to each of the droplet discharging heads 32 via the cables 47, the length of the cable 47 is preferably set about from 150 to 300 mm.

As illustrated in FIG. 3, the maintenance unit 37 is provided adjacent to the second support unit 20 in the scanning direction X. The maintenance unit 37 includes a cap 50 configured to perform capping to make a space, opened by each of the nozzle 40, a closed space by contacting the droplet discharging head 32. The capping is performed to suppress drying of the ink inside the each nozzle 40 of the droplet discharging head 32, and is an example of maintenance in the exemplary embodiment.

As illustrated in FIG. 2 and FIG. 3, the air blowing unit 16 includes a duct 51 that communicates an inside and an outside of the housing 44, and an air blowing fan 52 provided inside the duct 51. The duct 51 includes an air blowing port 53 that opens toward a movement region A of the carriage 31. The air blowing port 53 of the duct 51 is disposed overlapping the heat dissipation case 35 disposed in the carriage 31, in the vertical direction Z.

A plurality of the air blowing units 16 are provided side by side along the movement region A (scanning direction X) vertically above the movement region A of the carriage 31. Thus, the air blowing units 16 can blow a gas (air) toward an entire region of the movement region A of the carriage 31. That is, the air blowing units 16 are disposed along a movement path of the carriage 31, and blow a gas toward the heat dissipation case 35, and thus function as an airflow generating unit configured to indirectly cool each of the head driving circuits 34 inside the heat dissipation case 35.

Then, in a region in which the carriage 31 is not positioned in the movement region A of the carriage 31, the air blowing unit 16 blows a gas, and thus ink mist, a fragment of the medium M (e.g., paper powder), or the like, floating in the region, is discharged outside the housing 44 via a discharging port 54 (refer to FIG. 1) by the airflow generated by the air blowing unit 16. Thus, adhesion of the ink mist and the fragments of the medium M on the carriage 31 moving in the movement region A can be reduced, and for example, occurrence of defects in ink discharging from the each nozzle 40 due to the adhesion of the ink mist and the fragments of the medium M on a vicinity of the each nozzle 40 can be reduced.

On the other hand, in a region in which the carriage 31 is positioned in the movement region A of the carriage 31, since the gas blown from the air blowing unit 16 hits the heat dissipation case 35 supported by the carriage 31, the heat dissipation case 35 and each of the head driving circuits 34 inside the heat dissipation case 35 are cooled. That is, the heat dissipation case 35 and each of the head driving circuits 34 inside the heat dissipation case 35 are cooled by the airflow from the air blowing unit 16 toward the heat dissipation case 35.

Next, an electrical configuration of the printing apparatus 11 will be described.

Figure 5:
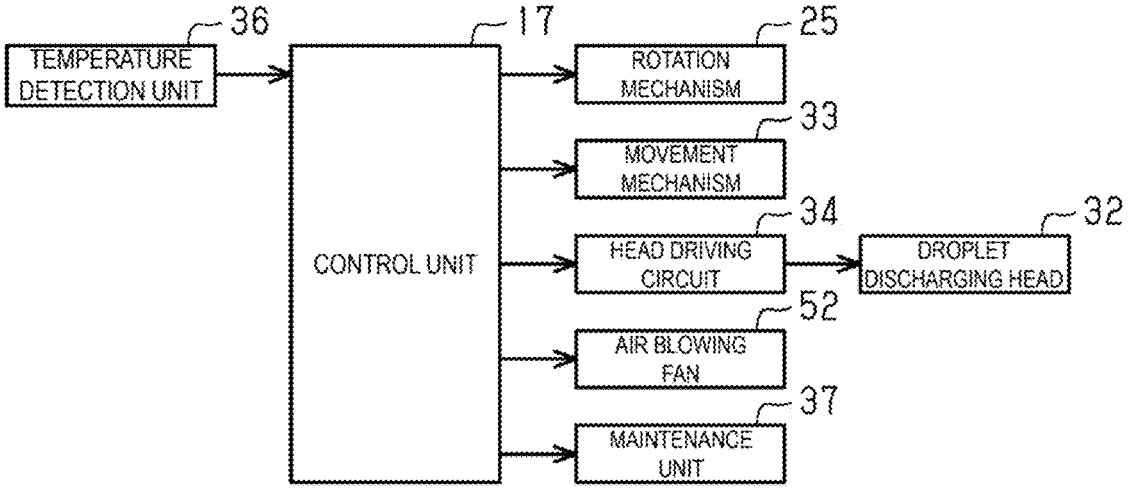
FIG. 5 is a block diagram illustrating an electrical configuration of the printing apparatus.

As illustrated in FIG. 5, an input side interface of the control unit 17 is electrically coupled with the temperature detection unit 36 configured to detect a temperature of the head driving circuit 34. On the other hand, an output side interface of the control unit 17 is electrically coupled with the rotation mechanism 25, the movement mechanism 33, the head driving circuit 34, the air blowing fan 52, and the maintenance unit 37.

Then, when a print job is inputted from a terminal (not illustrated), the control unit 17 controls the driving of each component to perform printing on the medium M. That is, the control unit 17 alternately performs a transport operation, in which the transport unit 14 transports the medium M by a unit transport amount in the transport direction F, and a discharging operation, in which ink is discharged from the each nozzle 40 of the each droplet discharging head 32 while the carriage 31 is moved in the scanning direction X, to perform printing on the medium M. Additionally, the control unit 17, when printing on the medium M is performed, drives the air blowing unit 16 to blow a gas toward the movement region A of the carriage 31.

Note that, the control unit 17, when making the printing unit 15 perform the printing operation, makes the droplet discharging head 32 discharge ink via the head driving circuit 34. That is, the control unit 17 outputs a control waveform to control a shape of a driving waveform outputted from the head driving circuit 34, a timing of outputting the driving waveform, or the like.

Then, the head driving circuit 34 inputs a driving waveform according to the control waveform to the actuator 41 to make the nozzle 40 corresponding to the actuator 41 discharge ink. For example, the head driving circuit 34, when discharging a large ink droplet from the nozzle 40 is desired, inputs a driving waveform with large amplitude to the actuator 41, and when discharging a small ink droplet from the nozzle 40 is desired, inputs a driving waveform with small amplitude to the actuator 41.

Further, in the printing apparatus 11 in which the head driving circuit 34 configured to drive the droplet discharging head 32 is supported by the carriage 31, due to heat generated in the head driving circuit 34, a temperature of the head driving circuit 34 and a temperature of the droplet discharging head 32 may rise in some cases. Thus, an air blowing fan for blowing air toward the head driving circuit 34 to cool the head driving circuit 34 may be disposed on the carriage 31, but in this case, vibration of the carriage 31 along with driving of the air blowing fan may deteriorate a discharging accuracy of the ink from the droplet discharging head 32.

Accordingly, in the exemplary embodiment, the heat dissipation case 35 for cooling the head driving circuit 34 is provided on the carriage 31, and thus an airflow for discharging the ink mist, the fragments of the medium M, or the like, hits the heat dissipation case 35. Accordingly, without providing the air blowing unit 16 on the carriage 31, a gas can be blown toward the heat dissipation case 35, and thus the head driving circuit 34 can be cooled while transmission of vibration from the air blowing unit 16 to the droplet discharging head 32 can be suppressed.

Next, action when the head connector 46 of the each droplet discharging head 32, and the circuit connector 45 of the each head driving circuit 34 are coupled by the each cable 47 will be described.

When the each head connector 46 and the each circuit connector 45 are coupled by the each cable 47, first, one end portion of the each cable 47 is inserted into the each circuit connector 45. At this time, one end portion of the each cable 47 is inserted into the each circuit connector 45 from the front side, and thus the each droplet discharging head 32 does not interfere with the task.

Next, in a state where the one end portion is inserted into each circuit connector 45, the other end portion of the each cable 47 is inserted into the each head connector 46. At this time, the other end portion of the each cable 47 is inserted into the each head connector 46 from the upper side, and thus the each head driving circuit 34 does not interfere with the task. Thus, the task of coupling the head connector 46 of the each droplet discharging head 32, and the each circuit connector 45 of the each head driving circuit 34 by the each cable 47 can be efficiently performed.

Further, in this case, the arrangement direction of the each droplet discharging heads 32 and the arrangement direction of the each head driving circuits 34 are the same, and thus a combination of the droplet discharging head 32 and the head driving circuit 34 coupled by the cable 47 can be easily changed.

Next, action of the printing apparatus 11 will be described.

When a print job is inputted from a terminal (not illustrated), the control unit 17 alternately performs the transport operation, in which the transport unit 14 transports the medium M by a unit transport amount in the transport direction F, and the discharging operation, in which ink is discharged from the each nozzle 40 of each droplet discharging head 32 while the carriage 31 is moved in the scanning direction X, to perform printing on the medium M.

Furthermore, the control unit 17, when printing on the medium M is performed, drives each of the air blowing units 16 to blow a gas toward the movement region A of the carriage 31. As a result, during printing on the medium M, the heat dissipation case 35 supported by the carriage 31 is continually blown from each of the air blowing units 16, and thus each of the head driving circuits 34 inside the heat dissipation case 35 are favorably cooled.

At this time, the control unit 17 acquires a detected temperature (ambient temperature inside the heat dissipation case 35) by the temperature detection unit 36 provided inside the heat dissipation case 35, and compares the detected temperature with a reference temperature stored in the control unit 17. Then, the control unit 17 performs air blowing from each of the air blowing units 16 in normal mode when the detected temperature is less than the reference temperature, and performs air blowing from each of the air blowing units 16 in strong mode, which is stronger than normal mode, when the detected temperature is greater than or equal to the reference temperature.

That is, the control unit 17 controls the air blowing state from each of the air blowing units 16 (generation of airflow from the airflow generating units) in accordance with the detected temperature by the temperature detection unit 36 provided inside the heat dissipation case 35. As a result, each of the head driving circuits 34 inside the heat dissipation case 35 are efficiently cooled. Note that the reference temperature is a determination value when determining whether air blowing from each of the air blowing units 16 is to be performed in normal mode or strong mode.

According to the exemplary embodiment described above, the following advantages can be obtained.

(1) In the printing apparatus 11, each of the droplet discharging heads 32 and each of the head driving circuits 34 are disposed so that the head connector 46 and the head driving circuit 34 do not overlap in the direction in which the cable 47 is pulled out from the head connector 46, and the circuit connector 45 and the droplet discharging head 32 do not overlap in the direction in which the cable 47 is pulled out from the circuit connector 45. As a result, the head driving circuit 34 does not interfere when the cable 47 is inserted into and removed from the head connector 46, and the droplet discharging head 32 does not interfere when the cable 47 is inserted into and removed from the circuit connector 45. Thus, the task of coupling the droplet discharging head 32 and the head driving circuit 34 by the cable 47 can be efficiently carried out.

(2) In the printing apparatus 11, the arrangement direction of the each droplet discharging head 32 and the arrangement direction of the each head driving circuit 34 are the same. As a result, the combination of the droplet discharging head 32 and the head driving circuit 34 coupled by the cable 47 can be easily changed.

(3) In the printing apparatus 11, the carriage 31 is supported by the side portion of the guide member 30, and the heat dissipation case 35 accommodating each of the head driving circuits 34 is disposed on the upper side of the guide member 30. As a result, compared to when the heat dissipation case 35 accommodating each of the head driving circuits 34 is disposed on the same side portion of the guide member 30 as the carriage (directly above the each droplet discharging head 32 inside the carriage 31), the weight balance of the carriage 31 can be improved. As a result, the carriage 31 can be stably moved in the scanning direction X. Additionally, a space is formed directly above the each droplet discharging head 32 inside the carriage 31, making it possible to easily perform maintenance tasks of the each droplet discharging head 32. Incidentally, when the heat dissipation case 35 accommodating each of the head driving circuits 34 is disposed directly above each of the droplet discharging heads 32 inside the carriage 31, the heat dissipation case 35 needs to first be removed from the carriage 31 when performing maintenance tasks on each of the droplet discharging heads 32, causing deterioration in the efficiency of the maintenance tasks of the each droplet discharging head 32.

(4) In the printing apparatus 11, each of the air blowing units 16 configured to blow air and cool each of the head driving circuits 34 are provided along the movement region A of the carriage 31. As a result, each of the head driving circuits 34 can be continuously favorably cooled, even during printing with the carriage 31 moving.

(5) In the printing apparatus 11, the control unit 17 performs air blowing from each of the air blowing units 16 in normal mode when the detected temperature (ambient temperature inside the heat dissipation case 35) acquired from the temperature detection unit 36 is lower than the reference temperature, and performs air blowing from each of the air blowing units 16 in strong mode, which is stronger than normal mode, when the detected temperature is higher than or equal to the reference temperature. As a result, the heat dissipation case 35 and each of the head driving circuits 34 inside the heat dissipation case 35 can be efficiently cooled.

MODIFIED EXAMPLES

Note that the exemplary embodiment described above may be modified as follows.

The direction in which the cable 47 is inserted into and removed from the head connector 46 of the each droplet discharging head 32, and the direction in which the cable 47 is inserted into and removed from the circuit connector 45 of the each head driving circuit 34 may be the same. As an example, the droplet discharging heads 32 and the head driving circuits 34 inside the carriage 31 may be disposed side by side so that the respective head connectors 46 and the circuit connectors 45 face the upper side.

The arrangement of the each air blowing unit 16 may be changed as desired as long as the each air blowing unit 16 can blow air toward the heat dissipation case 35. In this case, the air blowing direction toward the heat dissipation case 35 can be changed as appropriate in accordance with the arrangement of the each air blowing unit 16. That is, each air blowing unit 16 may be configured to blow air toward the heat dissipation case 35 from the side or from below, for example.

The each air blowing unit 16 may also serve as air blowing units for drying ink adhered to the medium M after printing.

The air blowing unit 16 may be mounted on the carriage 31 and configured to blow air directly toward the head driving circuits 34.

As for the air blowing unit 16, various configurations that can generate an airflow other than the air blowing fan 52 are adoptable. For example, a configuration in which an airflow is generated by receiving pressurized gas and the like supplied from an outside of the printing apparatus 11, and delivering the gas from the air blowing unit 16 to an inside of the printing apparatus 11 may be used. In this case, an opening/closing unit or the like capable of opening and closing the flow path of the gas to the air blowing unit 16 may be provided, making it possible to control entry of the gas, termination of entry of the gas, a flow rate of the gas, and the like. Additionally, the air blowing unit 16 may be a suction unit such as a suction pump configured to suction a gas. For example, a suction unit configured to suction a gas from an interior of the housing 44 may be provided at the discharging port 54 and the suction unit may be driven to generate an airflow toward the heat dissipation unit 35 supported by the carriage 31. In this case, the suction unit functions as the airflow generating unit.

The temperature detection unit 36 may not necessarily be provided inside the heat dissipation case 35 as long as the temperature detection unit 36 is provided to the carriage 31. That is, the temperature detection unit 36 may not necessarily be provided to the carriage 31, as long as the temperature detection unit 36 is provided in a region in which temperature rises in response to the heat generation of the head driving circuit 34.

The control unit 17 may not necessarily change the strength of the blowing air of the each air blowing unit 16 toward the heat dissipation case 35 in accordance with the detected temperature (ambient temperature inside the heat dissipation case 35) acquired from the temperature detection unit 36. That is, for example, the control unit 17 may be configured to control the driving of the air blowing unit 16 (air blowing fan 52) so that the strength of the air blowing from the air blowing unit 16 toward the heat dissipation case 35 is continuously constant regardless of the detected temperature (ambient temperature inside the heat dissipation case 35) acquired from the temperature detection unit 36.

A plurality of the air blowing units 16 may not necessarily be provided along the movement region A of the carriage 31. That is, one air blowing unit 16 may be provided and, even when a plurality of the air blowing units 16 are provided, the air blowing units 16 may not necessarily be provided along the movement region A of the carriage 31.

The air blowing unit 16 may be omitted.

The heat dissipation case 35 accommodating each of the head driving circuits 34 may be disposed on the upper side of the each droplet discharging head 32 (disposed on the side portion on the front side of the guide member 30) in the carriage 31, or may be disposed on the side portion on the rear side of the guide member 30, which is the side portion on the side opposite to the carriage 31, sandwiching the guide member 30.

The arrangement direction of the each droplet discharging head 32 and the arrangement direction of the each head driving circuit 34 may not necessarily be the same.

The medium M may be, besides a sheet, fiber, leather, plastic, wood, ceramics, or the like.

The medium M may be, besides the medium M unwound from the roll body R, a medium M having a single sheet-style, or a medium M simply having a long length.

In the exemplary embodiment described above, the droplet discharging device may be a liquid ejecting device configured to eject and discharge other liquid besides ink. Note that states of the liquid discharged from the liquid ejecting device upon formation into droplets of minute volume include a pellet-like shapes, teardrop-like shapes, or trailing string-like shapes. Further, the liquid here may be any material that can be ejected from the liquid ejecting device. For example, the liquid may be a substance in a liquid phase, including a liquid body having high or low viscosity, or a fluid state body such as sol, gel water, or other inorganic solvent, organic solvent, solution, liquid resin, or liquid metal (metallic melt). Further, such liquids include not only liquids of a single liquid state of the substrate, but also liquids obtained by dispersing, dissolving, or mixing particles of a functional material made of a solid, such as pigments or metal particles, into a solvent. Representative examples of the liquid include various liquid compositions such as a water-based ink, a non-water-based ink, an oil-based ink, a gel ink, and a hot melt ink, as described in the exemplary embodiment above. Specific examples of the liquid ejecting device include liquid ejecting devices that eject liquids including materials such as an electrode material and a color material used in manufacture of liquid crystal displays, electroluminescent (EL) displays, surface emitting displays, color filters, and the like in a dispersed or dissolved form. Additionally, a liquid ejecting device ejecting bioorganic substances used for biochip manufacturing, a liquid ejecting device used as a precision pipette and ejecting liquid to be a sample, a printing apparatus, a micro dispenser, or the like may be used. Further, the liquid ejecting device may be a liquid ejecting device that ejects a lubricant to a precision machine such as a clock or a camera in a pinpoint manner, or a liquid ejecting device that ejects a transparent resin liquid such as ultraviolet cure resin or the like on a substrate for forming a tiny hemispherical lens (optical lens) or the like used for an optical communication element and the like. Furthermore, the liquid ejecting device may be a liquid ejecting device that ejects an etching liquid such as an acid or an alkali for etching a substrate or the like.

REFERENCE SIGNS LIST

11 . . . Printing apparatus (droplet discharging device), 12 . . . Feeding unit, 13 . . . Support unit, 14 . . . Transport unit, 15 . . . Printing unit, 16 . . . Air blowing unit (airflow generating unit), 17 . . . Control unit, 18 . . . Holding member, 19 . . . First support unit, 20 . . . Second support unit, 21 . . . Third support unit, 22 . . . Heating unit, 23 . . . Transport roller, 24 . . . Driven roller, 25 . . . Rotation mechanism, 30 . . . Guide member, 31 . . . Carriage, 32 . . . Droplet discharging head, 33 . . . Movement mechanism, 34 . . . Head driving circuit, 35 . . . Heat dissipation case, 36 . . . Temperature detection unit, 37 . . . Maintenance unit, 38 . . . Carriage main body, 39 . . . Cover member, 40 . . . Nozzle, 41 . . . Actuator, 42 . . . Heat dissipation plate, 43 . . . Control cable, 44 . . . Housing, 45 . . . Circuit connector, 46 . . . Head connector, 47 . . . Cable, 48 . . . Guide rail portion, 49 . . . Carriage support unit, 50 . . . Cap, 51 . . . Duct, 52 . . . Air blowing fan, 53 . . . Air blowing port, 54 . . . Discharging port, A . . . Movement region, F . . . Transport direction, M . . . Medium, R . . . Roll body, X . . . Scanning direction, Y . . . Front-rear direction, Z . . . Vertical direction

The invention claimed is:

1. A droplet discharging device comprising:

a droplet discharging head configured to discharge a droplet;

a head driving circuit configured to drive the droplet discharging head;

an airflow generating unit configured to cool the head driving circuit, wherein a plurality of the airflow generating units are provided along a movement region of the carriage, the plurality of airflow units being separate from the droplet discharging head and attached to a housing that covers the droplet discharging device above the movement region of the carriage, wherein the plurality of airflow units are surrounded by a duct that is connected to the housing, the duct including an air blowing port that has a width that is smaller than a width of the airflow units;

a carriage configured to move in a scanning direction in a state in which the carriage supports the droplet discharging head and the head driving circuit; and a cable configured to electrically couple a head connector of the droplet discharging head and a circuit connector of the head driving circuit, the cable being detachably coupled to the head connector and to the circuit connector, wherein the droplet discharging head and the head driving circuit are disposed such that the head connector and the head driving circuit do not overlap in a direction of pull-out of the cable from the head connector, and the circuit connector and the droplet discharging head do not overlap in a direction of pull-out of the cable from the circuit connector.

2. The droplet discharging device according to claim 1, comprising:

a plurality of the droplet discharging heads disposed in an array; and a plurality of the head driving circuits disposed in an array, wherein an arrangement direction of the plurality of the droplet discharging devices and an arrangement direction of the plurality of the head driving circuits are the same.

3. The droplet discharging device according to claim 2, comprising a guide member configured to guide the carriage in the scanning direction while supporting the carriage, wherein the carriage is supported by a side portion of the guide member, and the head driving circuit is disposed at an upper side of the guide member.

4. The droplet discharging device according to claim 1, comprising a guide member configured to guide the carriage in the scanning direction while supporting the carriage, wherein the carriage is supported by a side portion of the guide member, and the head driving circuit is disposed at an upper side of the guide member.

5. The droplet discharging device according to claim 1, comprising a temperature detection unit supported by the carriage, wherein airflow generation from the airflow generating unit is controlled according to a temperature detected by the temperature detection unit.

* * * * *